US006149565A

United States Patent [19]

Meyer et al.

[11] Patent Number: 6,149,565

[45] Date of Patent: Nov. 21, 2000

[54] METHOD AND APPARATUS FOR PRODUCING BAGS IN TWO ROWS WITH SUBSEQUENT STACKING, ESPECIALLY FOR THE PRODUCTION OF BAGS FROM FLATTENED BLOWN THERMOPLASTIC FOIL

[75] Inventors: Armin Meyer, Köln; Jakob Schneider, Niederkassel, both of Germany

[73] Assignee: Lemo Maschinenbau GmbH, Niederkassel-Mondorf, Germany

[21] Appl. No.: 09/199,146

[22] Filed: Nov. 24, 1998

[30] Foreign Application Priority Data

Nov. 24, 1997 [DE] Germany ..... 197 51 798

[51] Int. Cl.[7] ..... B31B 1/00

[52] U.S. Cl. ..... 493/22; 493/926; 493/204; 493/11

[58] Field of Search ..... 493/22, 204, 203, 493/221, 226, 926, 11, 13

[56] References Cited

U.S. PATENT DOCUMENTS

| | | | |
|---|---|---|---|
| 4,216,705 | 8/1980 | Achelpohl et al. | 493/11 |
| 4,758,214 | 7/1988 | DeBin | 493/204 |
| 5,000,725 | 3/1991 | Bauknecht | 493/22 |
| 5,069,659 | 12/1991 | Bochtler et al. | 493/204 |
| 5,085,111 | 2/1992 | Birkhofer | 493/204 |
| 5,377,570 | 1/1995 | Giljam | 493/204 |
| 5,409,441 | 4/1995 | Muscoplat | 493/248 |
| 5,807,222 | 9/1998 | Totani | 493/22 |
| 5,860,905 | 1/1999 | Bruno | 493/204 |
| 5,876,317 | 3/1999 | Sigrist et al. | 493/22 |

FOREIGN PATENT DOCUMENTS

| | | | |
|---|---|---|---|
| 2 226 894 | 11/1990 | United Kingdom | 493/34 |

*Primary Examiner*—Stephen F. Gerrity
*Assistant Examiner*—Sam Tawfik
*Attorney, Agent, or Firm*—Herbert Dubno

[57] ABSTRACT

A method of and an apparatus for producing stacks of bags where, instead of connecting the position of the foil web, a marking on the foil web is detected and used to correct the positions of the devices which operate on the web. These devices can include a cutter for removing a strip from the upper layer of the flattened blown tubular web, the punch for punching holes in the lower layer, and the device for infolding are among the devices controlled in response to the marking. The latter can be printed on the web as it is unrolled or formed during the extrusion or foil blowing process.

12 Claims, 7 Drawing Sheets

METHOD AND APPARATUS FOR PRODUCING BAGS IN TWO ROWS WITH SUBSEQUENT STACKING, ESPECIALLY FOR THE PRODUCTION OF BAGS FROM FLATTENED BLOWN THERMOPLASTIC FOIL

FIELD OF THE INVENTION

The present invention relates to a method of simultaneously making at least two bags, and particularly padded bags for automatic packaging machines, utilizing a system for transversely welding the bags longitudinally cutting the pads of bags after they are formed, and punching the foil to provide openings which can be threaded over pins for handling the pads.

BACKGROUND OF THE INVENTION

In such a system, the flattened thermoplastic foil which results after extrusion and foil blowing, can have its longitudinal edges infolded to form the bottom or sides of the bag, the foil can be punched to provide holes enabling the bags to be threaded onto pins, e.g. in stacking, a strip can be cut from one of the layers to define the bag opening, and pairs of the bags, forming a bag segment, can be transversely cut from the web, simultaneously sealing edges of the bag, and stacked on the pins. The pads can be longitudinally cut between them so that individual bag pads are produced. The stacking device can be provided with means for transferring the bag segments from the conveyor to the stacker.

In the production of such bags, especially for padded bags for automatic packaging machines, it has been found to be essential that the bag pad be formed with high precision to enable the bags to be properly positioned in a dispenser or the like, e.g. in an automatic packaging machine. It is not possible to utilize conventional stacking methods when pads of highly precise dimensions and bag alignment is required and when conventional apparatus is used for preparing bag pads, it is found that the apparatus operates too slowly. Apart from the need for exact orientation, there is a need to maintain the fabrication tolerances of the bags within narrow limits.

OBJECT OF THE INVENTION

It is the principal object of the present invention, therefore, to provide a bag making process and apparatus in which there can be greater fabrication or positioning accuracy and a high quality stack or pad of such bags can be made without the drawbacks of earlier systems and without expensive and complex means for that purpose.

Another object of the invention, is to provide an improved, precisely oriented stack of bags without the drawbacks of earlier systems.

SUMMARY OF THE INVENTION

These objects and others which will become apparent hereinafter in a system in which one no longer adjusts the position of the foil web relative to the processing device. Rather, the processing device, at least at some of the stations, is laterally positioned based of detection upon a marking of the web, thereby markedly increasing the position in the manufacturing of the device and the accuracy with which the bags are made and stacked and thus the adherence of both the bag configuration and dimensions and the pad configuration and dimensions to narrow tolerances.

Furthermore, since the web itself is no longer shifted in a lateral sense but the bag forming and stacking device and elements are controlled (i.e. repositioned as required) laterally, the control and adjustment can be carried out substantially more quickly and with greater precision than is the case with adjustments (control) of the web, especially when the web is moving along the path at a very high speed.

The simple and rapid adjustment of the devices or elements at each station allows loss of material in the web to be greatly reduced and optimizes the formation of the pads of bags especially because the holes in the bags can be made with great precision. The longitudinal slitting of the pads from the respective stacks has been found to be of greater precision as well and the pads can be used with significant improvement especially in bread packaging or the packaging of bread slices in automatic packaging machines receiving such pads of bags.

The marking can be applied in various ways, for example it can be a printed mark extending longitudinally the entire length of the web and printed during one side of the web and even during winding up of the web into a coil. It can be formed during extrusion of the blown foil tube or in later processing for example, during the bag making processed or during the flattening and rolling up of the web. According to another aspect of the invention, one or both of the edges may form the mark.

The detection of the mark and the edges can be effected by conventional photocells or the like and it can be carried out continuously or at intervals as occasion arises and at each of the locations at which control is to be effected or at a location common to control at a number of stations. A sensing head may be provided especially at the infold station, the hole punching station, the longitudinal cutting station and optionally at the station which the strip is removed.

The process of the invention can comprise:

(a) feeding a web having an upper foil layer and a lower foil layer along a bag-producing path and forming the web with at least one marking distinguishing a lateral position of the web on the path;

(b) at a punching station forming the web with a pair of openings at least on opposite sides of a longitudinal axis for each of a succession of pairs of bags to be produced;

(c) separating the web into a succession of bag segments each corresponding to a pair of bags;

(d) stacking the bag segments with pins at a stacker extending through the openings to form a segment stack;

(e) longitudinally cutting through the stack to separate pads of the bags from one an the; and (f) detecting the marking and controlling at least one device at the station for laterally positioning the device in response to the detected marking and independently of a lateral position of the web.

The apparatus can comprise:

means for feeding a thermoplastic synthetic resin web flattened from a blown extruded foil tube having an upper foil layer and a lower foil layer along a bag producing path and forming the web with at least one marking distinguishing a lateral position of the web on the path;

a folding station along the path having folding devices for folding inwardly opposite edges of the tube;

a slitting station along the path having a cutting device for longitudinally cutting a strip from one of the layers;

a punching station along the path having punching devices for forming the web with pairs of openings at least on opposite sides of a longitudinal axis for each of a succession of pairs of bags to be produced;

means along the path for separating the bags into a succession of bag segments each corresponding to a pair of bags;

means along the path for stacking the bag segments with pins of a stacker extending through the openings to form a segment stack;

means along the path is longitudinally cutting through the stack to separate pads of the bags from one another; and means for detecting the marking and controlling at least one device at at least one of the stations for laterally positioning the control device in response to the detected marking and independently of the lateral position of the web.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
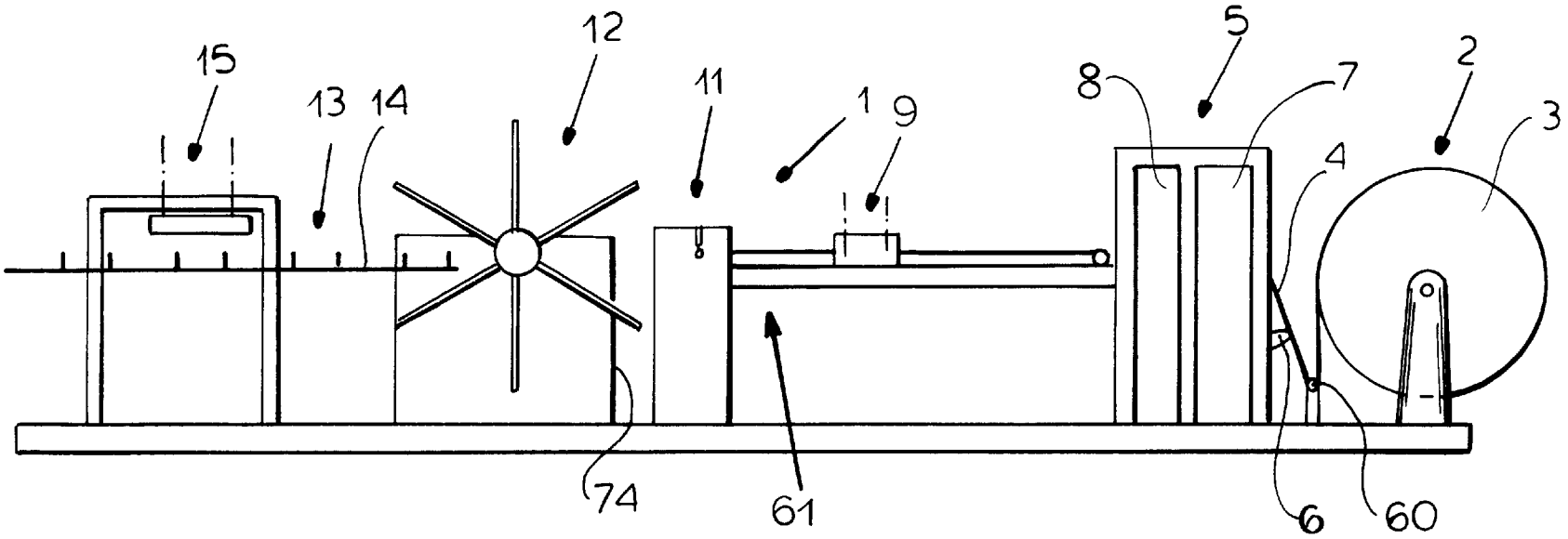
FIG. 1 is a side elevational view in highly diagrammatic form of a bag making machine according to the invention.

FIG. 1 schematically shows a bag fabricating machine which produces simultaneously two bags which are packaged in stacks and generally are known as retailing bags, vending bags or bags of a similar type which can be automatically pulled open on the pad or automatically or manually pulled off the pad to allow rapid filling with goods, e.g. at the checkout line of a food vendor or in a packaging machine.

The bag-making machine can comprise an unwinding stand 2 on which a wound roll 3 of a tubular plastic foil web 4 can be unwound, e.g. via the guide 60 and fed for processing down a processing line represented generally at 61 and comprising, where necessary to support the web, conveyer belts, chains or the like. At the first processing stand, represented at 5, a marking line printer 6 is provided to apply a marking to the web 4. The function of this marked line will be discussed in greater detail below.

The stand 5 itself can be provided with drive rolls, tension rolls or like devices for operating upon and applying tension to the web.

Figure 2:
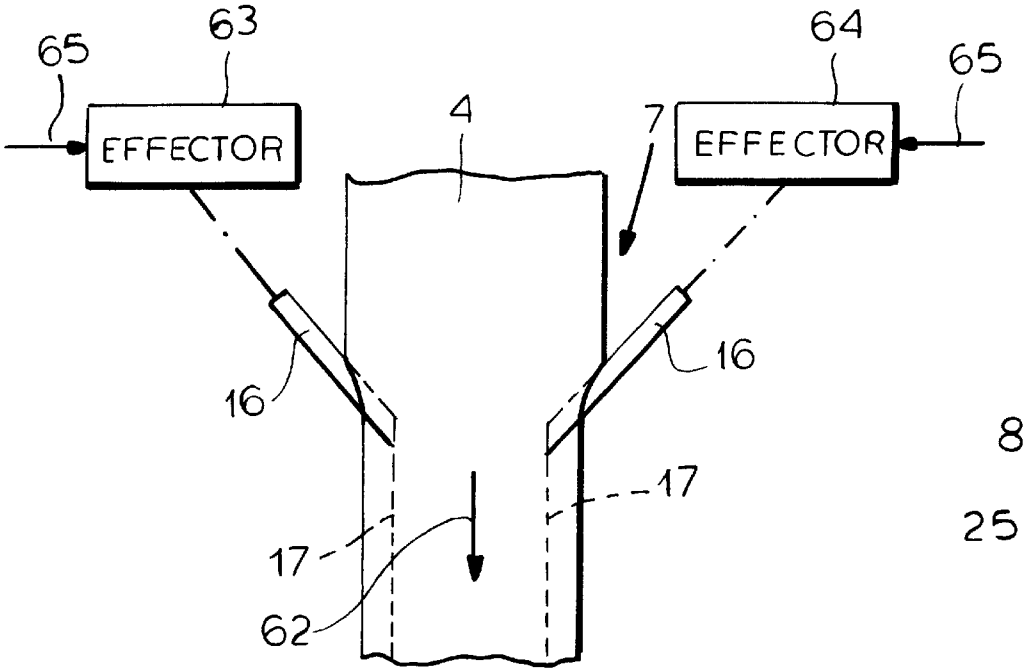
FIG. 2 is a diagrammatic plan view showing the side or bottom fold formation.

The processing device 7 can be provided with a side or bottom gusset or infolding device as represented at 16 (FIG. 2) and, if desired, with a strip cutting unit 8 (FIG. 3) which can cut a strip from one of the sides of the folded web as it passes through the unit 5.

Figure 5:
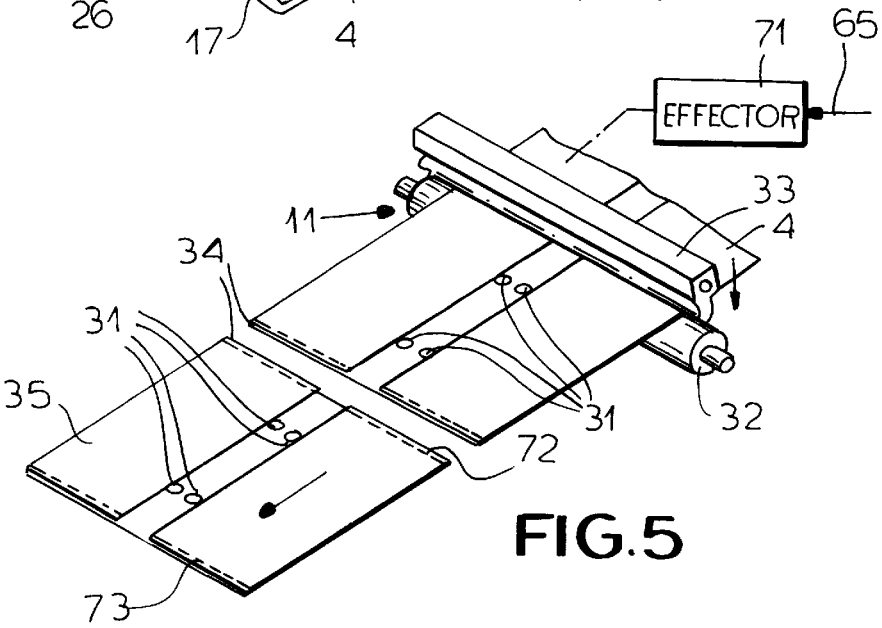
FIG. 5 is a perspective view of a transversing cutter for subdividing the web into bag segments transversely of the length of the web.
Figure 6:
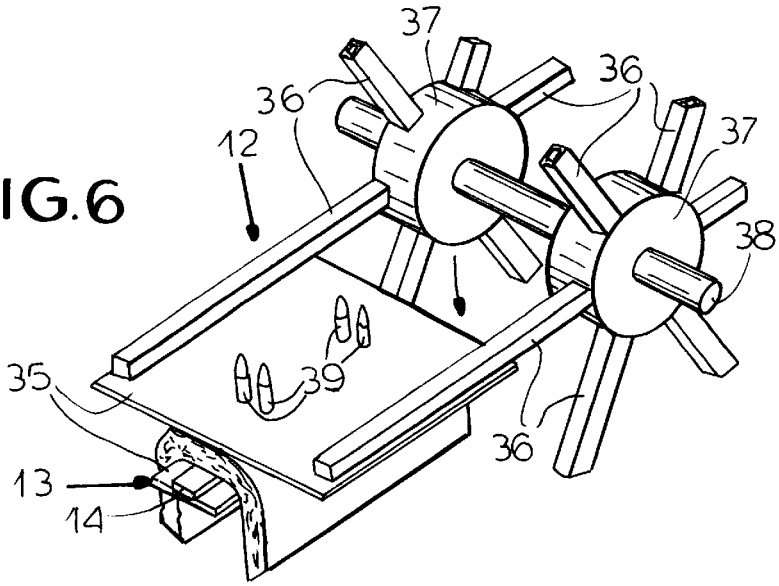
FIG. 6 is a perspective view of the system whereby bag segments are transferred, showing a part of the stacking device.
Figure 7:
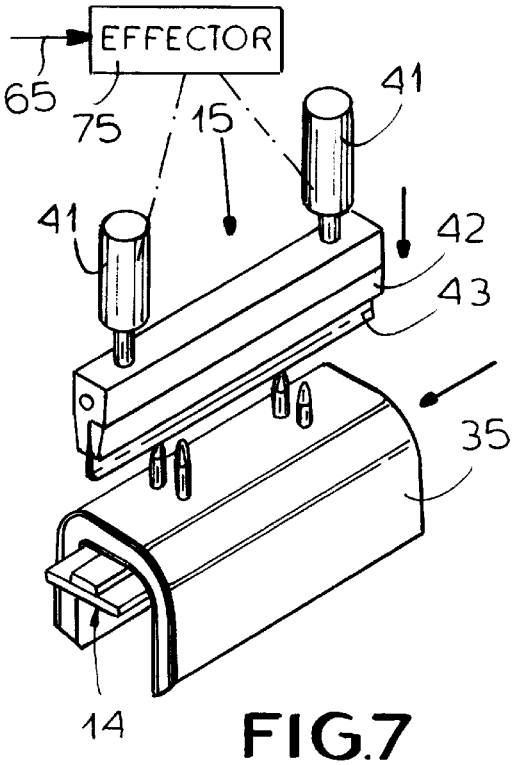
FIG. 7 is a perspective view of the portion of the stacking device in the region of the longitudinal cutter which subdivides the bag segments longitudinally into respective bag stacks.
Figure 8:
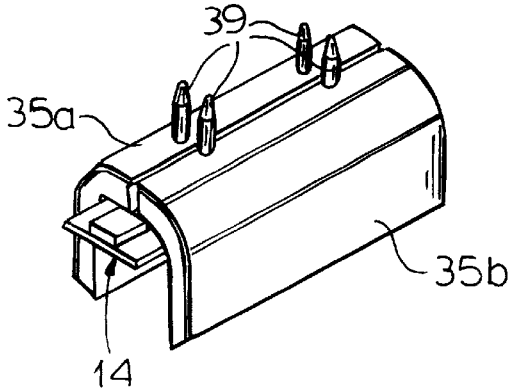
FIG. 8 is a diagrammatic perspective view of the stacking device after separation of the two stacks or pads of bags by the longitudinal cutter which forms the bag segments into individual bags.

Downstream of the processing stand 5, a hole punch 9 (FIG. 4) is provided and following the hole puncher 9, the processing line comprises a transverse cutter (FIG. 5) and a unit which is capable of transversing the bag segments formed in the 5 transverse cutter 11 and represented diagrammatically at 12 (FIG. 6), followed by a pin stacking arrangement 14 forming part of a stacking device generically represented at 15 (see FIG. 7) the longitudinal cutter, which separates the bag segments into bags has been shown in FIG. 7 as well.

The infolding device 16 (FIG. 2) which may be considered to produce wide folds or gussets or bottom folds or gussets, depending upon the way the bag handles and bag mouth are to be formed, are lateral swords which extend inwardly of the flattened tubular web 4 to produce the sides or bottom folds 17. In the embodiments which will be described hereinafter, the folds 17 are bottom folds. The tubular web 4 may be slightly inflated to permit the sword 16 to extend into the web as it is advanced in the direction of the arrow 62. The lateral swords 16 can be operated by effectors 63 and 64 with control inputs 65, responsive as will be described in greater detail hereinafter, to the position of the web 5 and the movements transverse to that position of the line marked upon the web. The method of control in accordance with the present invention will be discussed in greater detail hereinafter.

Figure 3:
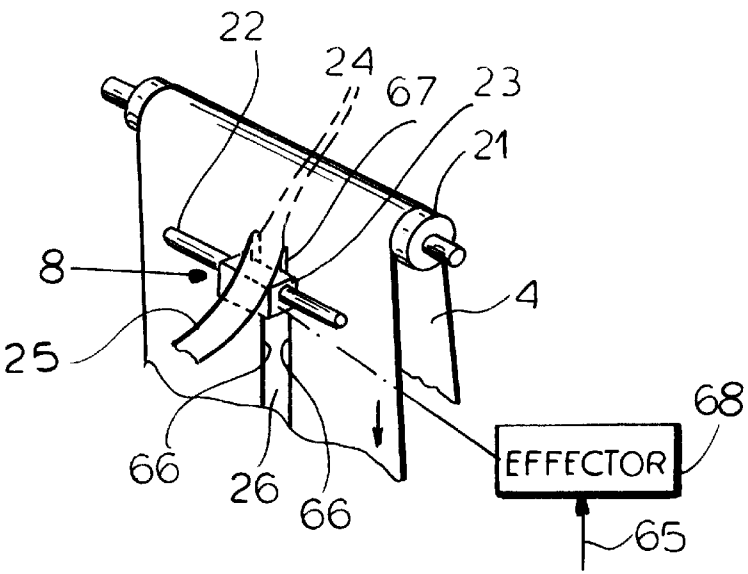
FIG. 3 is an enlarged perspective detail of a strip cutting device.

FIG. 3 shows a strip cutting device 8 which, as the web 4 passes over a deflecting roller 21, cuts a strip 25 from the upper layer of the flattened tubular or folded web 4, thereby leaving a gap 26 therein between two edges 66. The cutter 8 can comprise a head 23 carrying a blade 67 and slidable on the support rod 22. A further effector 68 may be provided for the head 23 and receives an input 65 as will be described in greater detail to control the position of the head and thus for formation of the gap 26 and hence the position of the bag opening, based upon the detection of the marking applied to the web. The effectors described herein may be, for example, servomotors. If the gap 26 is not entered on the web, one of the bags produced can have an opening which is higher, i.e. a greater distance from its bottom fold, than the other bag.

Figure 4:
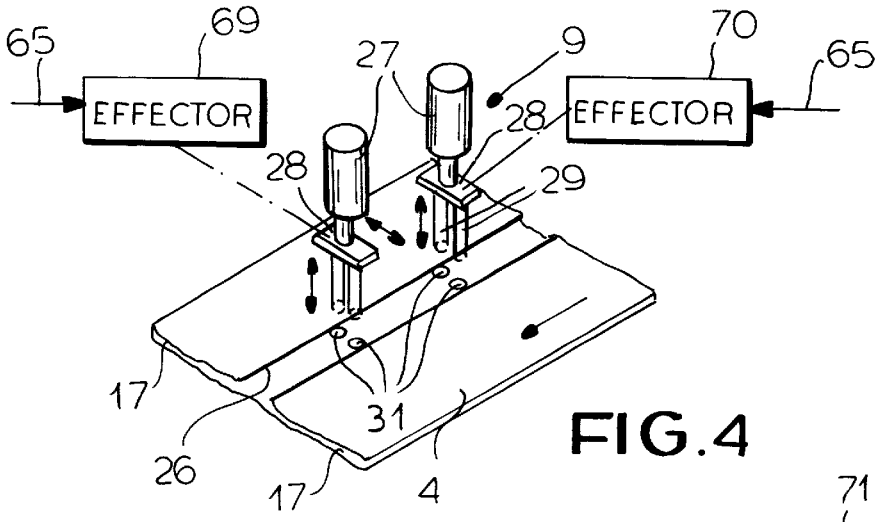
FIG. 4 is a diagrammatic perspective view of a detail of FIG. 1 showing the hole pumping device.

FIG. 4 shows the whole punching system which comprises two actuators 27 each of which carries a pair of pumping tools (i.e. punches) 29 for producing two spaced apart but relatively close receiving holes in the region of the gap 26. The support plates 28 for the punches may themselves be movable by effectors 69, 70 with control inputs 65 as has been described, based upon the marking applied to the web.

After stamping of the holes 31, the web 4 may be subdivided into respective double bag segments 35 by a transverse cutter and welding unit represented at 11. This unit 11 comprises a lower welding roller which cooperates with the upper blade 33 so that the latter, when pressed downwardly by its effector 71 having an input 65 for controlling this cutter based upon the line marked on the web as will be described in greater detail hereinafter. The cutter 33 and the roller 32 can be heated resistively or inductively or can inductively heat the pad so that the bag segments 35 are separated from the web and sealed together along the cut edges thereof as represented at 72 and 73. A separating weld seam has been designated 34 in FIG. 5.

FIG. 6 shows in greater detail the use of radially extending arms 36 journalled at 37 via a shift 38 on a housing 74 (FIG. 1) and serving to lift the segments 38 and swing them through 180° to deposit them upon the stacking device 13. The arms 36 can have suction units enabling them to lift the respective segments 35 and swing those segments further that their holes are placed upon upwardly projecting pins 39 set at the spacing of the openings 31.

Figure 9:
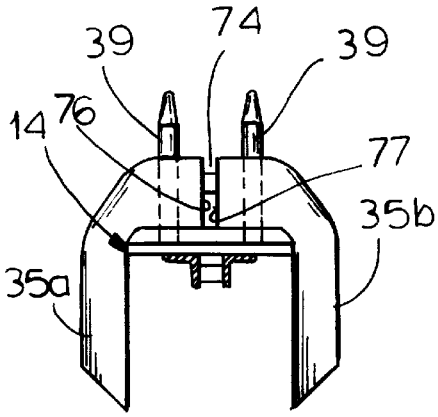
FIG. 9 is a front elevational view of the device of FIG. 9.

The stacking device (see FIGS. 6 through 9), comprises a rail 14 upon which the bag segments 35 can be supported and from which the bag segments hang down on opposite sides as shown at 35*a* and 35*b* in FIG. 9. The stacker cooperates with a cutting unit generally represented at 15 and having two hydraulic or pneumatic actuators 41 which act upon a cutting beam 42 to cause the blade 43 to sever the stacks between them, thereby forming the individual pads 35*a* and 35*b* on a pair of pins extending in the longitudinal direction. The cut itself is represented at 74 in FIG. 9. An effector for controlling the actuators 41 is provided at 75 and has an input 65 to insure that the longitudinal cutting will occur in response to the marking applied to the web.

The cutter 43 may be heated to a temperature sufficient to cause the pads to bond together along the cut edges 76 and 77, these edges being either welded or melted together in this fashion.

Figure 10:
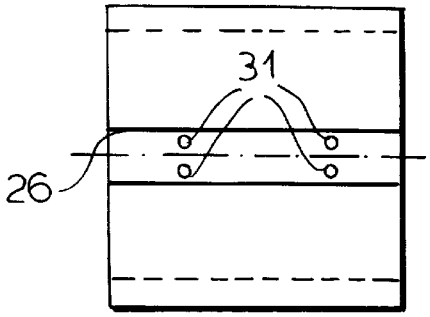
FIG. 10 is a plan view of a first embodiment of a double foil web segment attached to form a bag segment of the type described.
Figure 11:
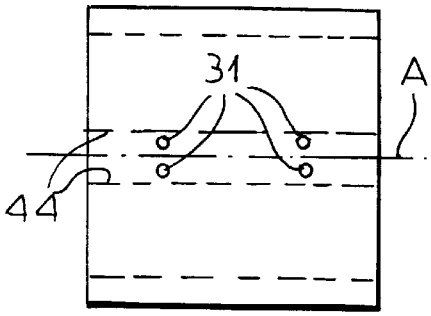
FIG. 11 is a view similar to FIG. 10 of an alternative double foil bag segment.

FIGS. 10 and 11 show different configurations of bags which can be made by the process and apparatus according to the invention. FIG. 10, for example, shows vending bags with an edge or lip in which the bag opening does not have edges lying at the same height as can result from an offset arrangement of the strip 35 and the gap 26 produced as described in FIG. 3.

FIG. 11 shows the configuration of a doubled web segment in which perforations are provided along lines 44 flanking the center line A so that the bags can be of equal height as the bags pulled away from the respective pad and separate along these perforation lines.

Figure 15:
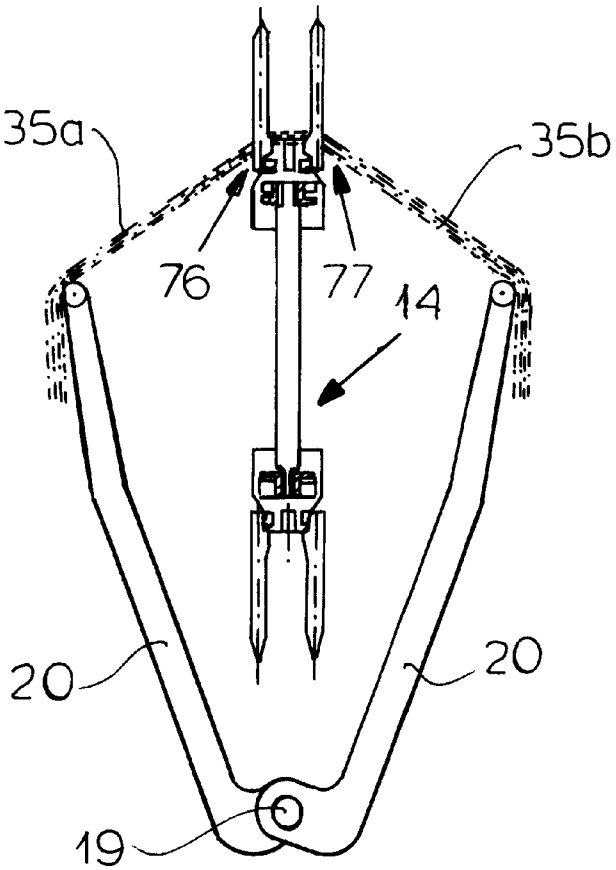
FIGS. 14 and 15 are elevational views in two operating positions showing details of the stacking arrangement.
Figure 14:
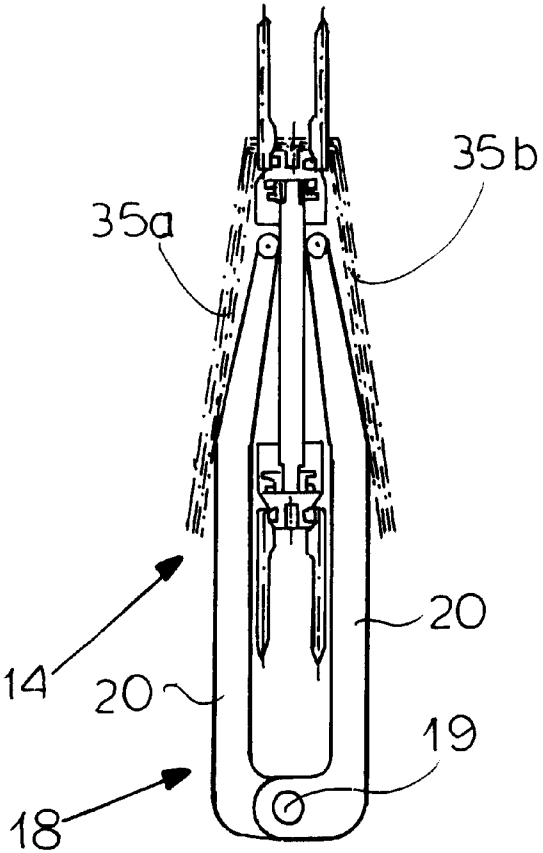

FIGS. 14 and 15 show a spreading device 18 which can be arranged in the region of the stack support 14 which, in turn, has the pins 39 previously described, and comprises a pair of spreading arms 29 swingable about a common pivot axis 19. The spreading of the stacks is necessary to allow the stacks themselves to be provided with U-shaped stirrups. These wire stirrups are inserted from below with the bag spread as shown in FIG. 15 into the openings as represented by the arrows 76 and 77 in FIG. 15. Insertion of the wire stirrups from below through the two openings 31 on each side of the longitudinal axis is not possible with earlier machines forming two bag pads on either sides of the longitudinal median plane of the machine.

Figure 12:
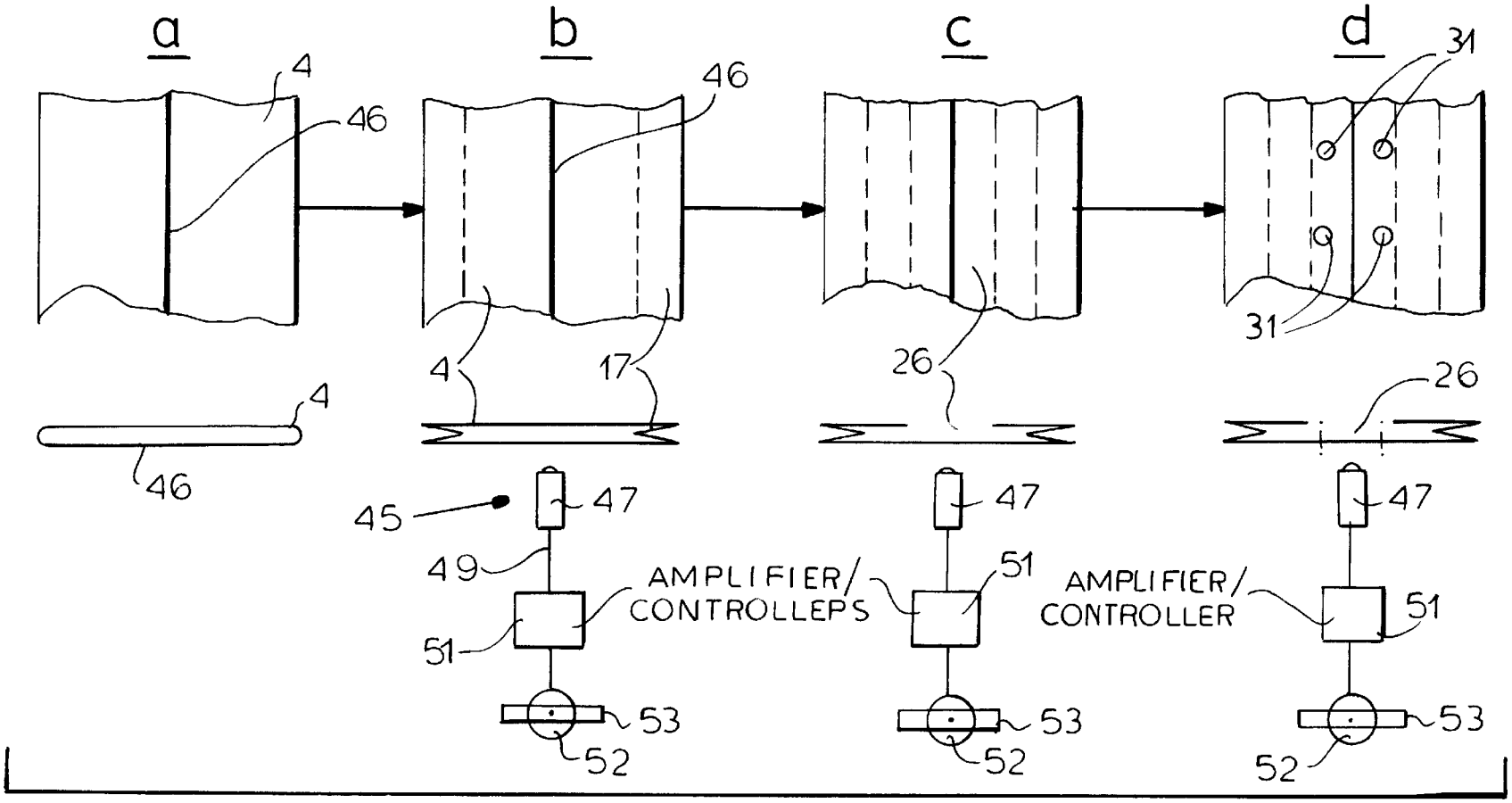
FIG. 12 is a diagram showing steps a–d in the manufacturing using line detection.

FIG. 12 illustrates a sensing device 47 which is responsive to a marking line 46 applied to the foil web 4 by the marking line printer 6. In step (a) of FIG. 12 it is assumed that the line 46 has been applied on the underside of the flattened tubular web at 46 in FIG. 1. The marked line 6 cooperates with a sensing head 47 which may be, for example, a photocell and which can be provided at any location that an effector is to be controlled as has previously been described. In step (b), for example, it is assumed that the inward folding of the edges 17 is being produced, either symmetrically or asymmetrically, but in any case under the control of the detection by the photocell 47 of the line 46. An amplifier and controller responsive to the input from the photocell produces an output signal 65 to the effector which may include the servomotor 52 and a drive 53 connecting that servomotor to the swords or any other device at that stage which must be controlled based upon the line 46. In step (c), of course, the formation of the gap is controlled once again by the photocell detection of the line 46 and the amplifier/controller 52 providing its input to the servomotor 52 and the operating mechanism for positioning the head 23 represented by the bar 53. In step (d), the servomotor 52 and its mechanism 53 control the positions of the punches from the openings 31.

Figure 13:
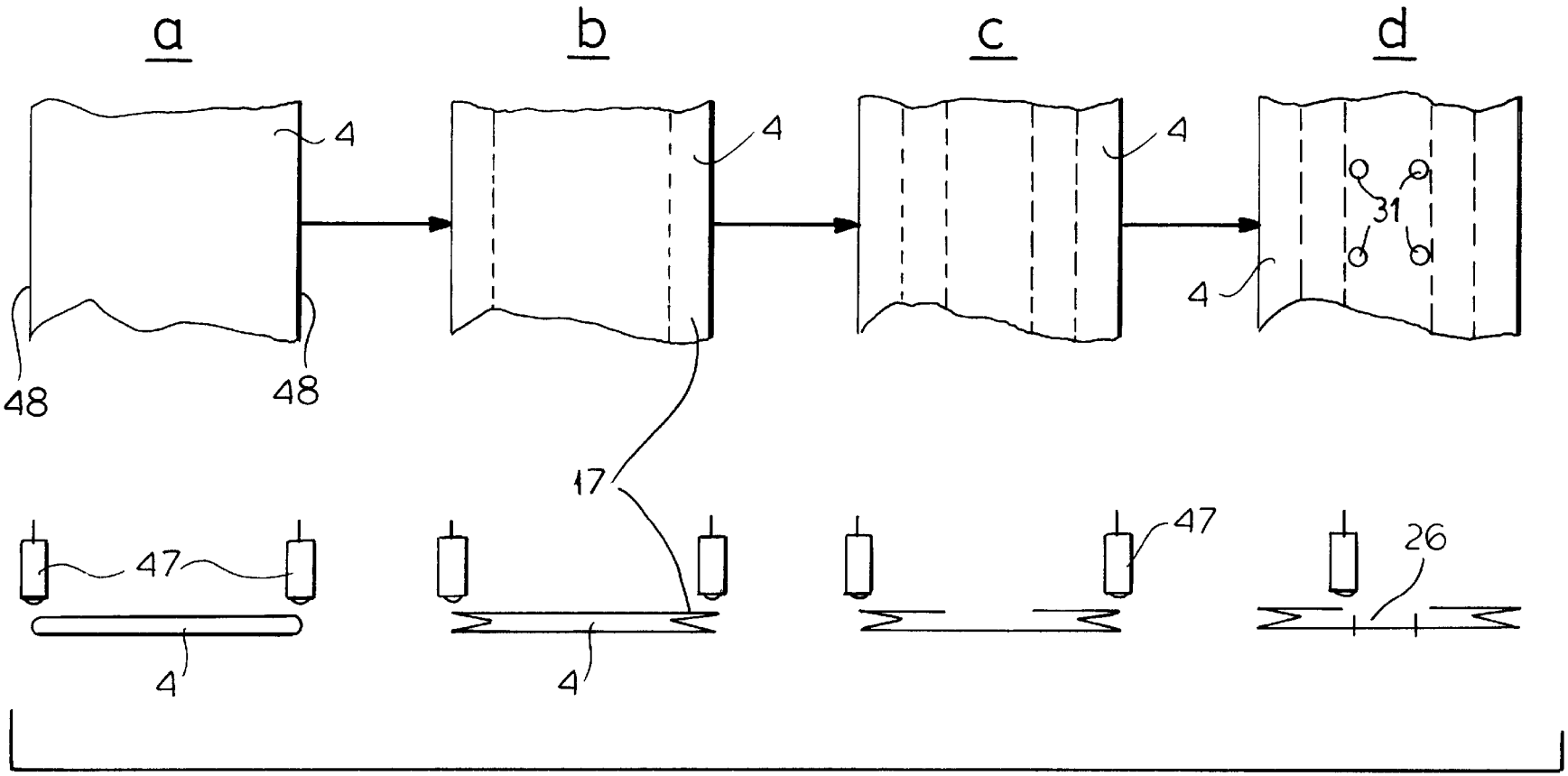
FIG. 13 is a view similar to FIG. 12 but showing the process carried out with edge detection.

Instead of applying a marking to the web, the system of the invention can monitor as the "marking" the actual edges of the web as shown by the photocells 47 in FIG. 13, the photocell positions controlling the effectors previously described. The stack forming elements, for example, the position of the pin conveyer 13 can be adjusted similarly.

We claim:

1. A process for producing stacks of bags which comprises at least the steps of:

(a) feeding a web having an upper foil layer and a lower foil layer along a bag-producing path in a feed direction and forming said web with at least one marking distinguishing a lateral position of said web on said path;

(b) at a punching station forming said web with a pair of openings at least on opposite sides of a longitudinal axis of the web for each of a succession of pairs of bags to be produced;

(c) separating said web into a succession of bag segments each corresponding to a pair of bags;

(d) stacking said bag segments with pins at a stacker extending through said openings to form a segment stack;

(e) longitudinally cutting through said stack to separate pads of said bags from one another; and (f) detecting said marking and automatically in response to detection of said marking laterally positioning said punching station transversely to said direction for laterally positioning said punching station independently of a lateral position of said web.

2. The process defined in claim 1 wherein, prior to said formation of said openings, said web is passed through a slitting station in which an elongated gap is formed in one of said layers by a slitting device, said slitting device being automatically laterally positioned transverse to said direction in response to detection of said marking independently of a lateral position of said web.

3. The process defined in claim 2 wherein, prior to formation of said openings, said web is passed through an infolding station wherein opposite edges of said web are folded inwardly by respective devices automatically shifted transverse to said direction in response to said detected marking and independently of a lateral position of said web.

4. The process defined in claim 3 wherein, in step (a), said marking line is applied to one of said layers and extends longitudinally along said web.

5. The process defined in claim 4 wherein said marking line is printed on said web.

6. The process defined in claim 5 wherein said marking line is applied during manufacturing of said web.

7. The process defined in claim 5 wherein said marking line is applied to an underside of said lower layer of said web.

8. The process defined in claim 3 wherein said marking in step (a) is at at least one of said longitudinal edges of said web.

9. The process defined in claim 3 wherein the detection of said marking is effected a multiplicity of times during production of bags from said web.

10. The process defined in claim 9 wherein the detection of said marking is effected at each of said stations.

11. The process defined in claim 10 wherein said web is a flattened blown tube.

12. The process defined in claim 11, further comprising the step of spreading said segment stacks following step (d) and inserting wire stirrups through said holes of bags of each of said stacks from below.

* * * * *